US007060918B1

(12) United States Patent
Reed

(10) Patent No.: US 7,060,918 B1
(45) Date of Patent: Jun. 13, 2006

(54) NORMAL AND EMERGENCY COMBINATION LIGHT SWITCH

(76) Inventor: Roger Glenn Reed, 6704 Hoover Rd., Indianapolis, IN (US) 46260

( * ) Notice: Subject to any disclaimer, the term of this patent is extended or adjusted under 35 U.S.C. 154(b) by 6 days.

(21) Appl. No.: 10/905,828

(22) Filed: Jan. 21, 2005

(51) Int. Cl.
*H01H 9/26* (2006.01)

(52) U.S. Cl. ..... 200/50.32; 200/331; 200/334

(58) Field of Classification Search ..... 200/50.32, 200/50.33, 50.37, 50.4, 334, 329–331
See application file for complete search history.

(56) References Cited

U.S. PATENT DOCUMENTS

| | | | | | |
|---|---|---|---|---|---|
| 2,903,527 | A | | 9/1959 | Woodruff | 200/6 |
| RE26,113 | E | * | 11/1966 | Carter et al. | 200/50.34 |
| 3,311,716 | A | | 3/1967 | Carlson et al. | 200/6 |
| 3,588,409 | A | | 6/1971 | Lattinen | 200/153 LA |
| 4,112,270 | A | * | 9/1978 | Rys | 200/50.32 |
| 4,267,460 | A | | 5/1981 | Habighorst | 307/38 |
| 4,700,586 | A | * | 10/1987 | Miura | 200/50.36 |
| 4,760,278 | A | * | 7/1988 | Thomson | 200/50.37 |
| 6,031,193 | A | * | 2/2000 | Flegel | 200/50.33 |
| 6,563,063 | B1 | * | 5/2003 | Moore | 200/50.33 |

FOREIGN PATENT DOCUMENTS

JP 2002298679 A * 10/2002

* cited by examiner

*Primary Examiner*—Michael A. Friedhofer

(57) ABSTRACT

A standard 2-gang wallbox-mountable light switch assembly comprising two switches for controlling electrical power from two separate circuits, one normal and one emergency power, to two separate lighting loads is disclosed. The assembly comprises two toggle switches, a yoke common to both switches and an axle common to both toggle switches for operating in unison both toggle switches. A single handle is provided that is integral to the axle and extends through the yoke for manual grasping for switching on-off. A partition creates a barrier between the electrical components of the two toggle switches when mounted within a standard 2-gang wallbox. Separation of normal and emergency circuits is a requirement of the National Electric Code (NEC) 700.9 (B).

5 Claims, 2 Drawing Sheets

PRIOR ART REQUIRES 12 TERMINATIONS.

THE PRESENT INVENTION REQUIRES 4 TERMINATIONS.

NORMAL AND EMERGENCY COMBINATION LIGHT SWITCH

BACKGROUND OF THE INVENTION

This invention relates to the control of normal and emergency lights located in the same room whereas the emergency egress lights are powered by an emergency circuit that transfers to an emergency generator set upon failure of normal commercial power. What ever method of control is used, it must comply with the National Electric Code (NEC) 700.9 (B) requirement that normal and emergency circuits cannot occupy the same enclosure.

DESCRIPTION OF THE RELATED ART

A first method of complying with the National Electrical Code (NEC) 700.9 (B) is to use two separate wall switches in separate enclosures whereas the first switch turns on-off lights in a room that are connected to a normal circuit and the second switch turns on-off lights that are connected to an emergency circuit for emergency egress of the room. A problem with this method is that many times occupants entering a room will turn on the switch that controls the normal lights but will fail to turn on the switch that controls the emergency lights, therefore, if there is a failure of the normal commercial power they are left in darkness because the emergency light switch was left in the off position.

A second method of complying with NEC 700.9 (B) is to use a relay device such as one made by The Bodine Company which allows a single switch at the door of a room to control both the normal lights and the emergency lights. Bodine calls it GTD-20 and its wiring diagram is shown in FIG. 5. A first disadvantage with this method is that the relay device is more expensive than a manually operated light switch. A second disadvantage with this method is that it requires more man-hours to install because more wiring is required compared to the present invention. A third disadvantage with this method is that electrically controlled relay devices tend to have a higher failure rate than a simple mechanical toggle switch.

A third method of complying with NEC 700.9 (B) is to wire the emergency egress lights directly to the emergency circuit without a switch to turn them on-off. The emergency egress lights are always on so occupants aren't left in the dark when normal commercial power fails and emergency generator power comes on. A first disadvantage with this method is that it wastes energy to leave the emergency egress lights on 24 hours a day seven days a week. A second disadvantage with this method is early failure of the lamps because they are operating about three times longer each day than they would be if they were switched. Unfortunately, many speculative buildings are built using this method.

It is the object of the present invention to provide for a single toggle switch handle at the door of a room that controls both normal lights and emergency lights without the use of electric relays therewhile complying with NEC 700.9 (B).

BRIEF SUMMARY OF THE INVENTION

The present invention is a combination light switch assembly that is arranged to provide for control of the on-off switching of both a normal circuit and an emergency circuit supplying power to normal and emergency lights respectively.

It is a standard 2-gang wallbox-mountable system with a single handle in correspondence with a standard opening of a standard 2-gang wallbox faceplate through which said handle protrudes for grasping and switching on-off in unison two circuits. The handle operates a first switch in a manner consistent with common commercially available light switches and further, through an integral axle about which the toggle handle pivots when operated between on-off positions, it also operates a second switch that is a mirror image of the first switch except the axle does not have an integral handle related to the second switch. The two switches are separated from each other by a partition inserted at the midpoint of the wall box thereby complying with the National Electrical Code (NEC) 700.9 (B). The partition has an aperture with a radius 2 mm larger than the axle radius thereby providing a clearance between the axle and the partition that complies with Underwriters Laboratories (UL) clearance requirements. The partition is located so the axle extends from engagement with the toggle mechanism of the first switch, passes perpendicularly though the aperture in the partition, and extends to engagement with the toggle mechanism of the second switch. A standard 2-gang wallbox coverplate with an opening for a handle on one side and blank on the other side can be used in conjunction with the invention.

BRIEF DESCRIPTION OF THE SEVERAL VIEWS OF THE DRAWINGS

For the purpose of illustrating the current invention, there is shown in the drawings a form that is presently preferred; it being understood, however, that this invention is not limited to the precise arrangement and instrumentalities shown.

DETAILED DESCRIPTION OF THE INVENTION

Figure 1:
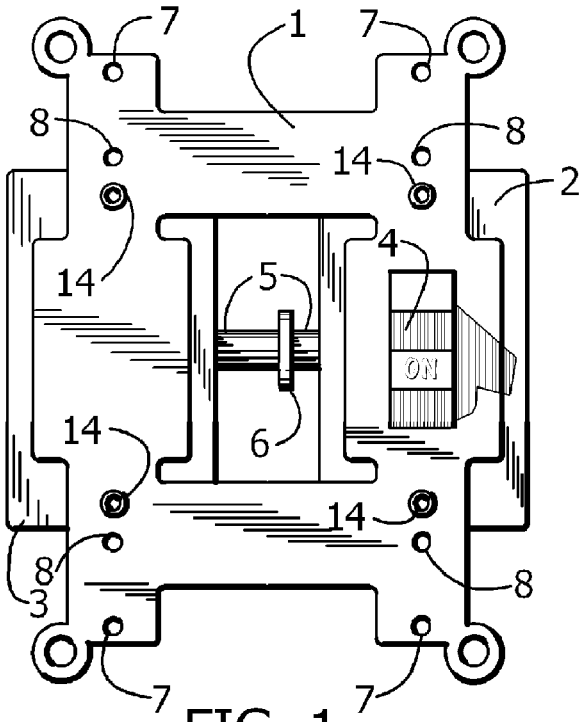
FIG. 1 is a front view of the standard 2-gang wallbox-mountable combination light switch assembly of the present invention showing two switches riveted to a common yoke and interconnected by a common axle.

Referring to the drawings in detail wherein like elements are indicated by like numerals, FIG. 1 illustrates two switch bodies 2 and 3 that are attached with rivets 14 to a yoke 1 constructed of an electrically non-conductive flat plate. The switch bodies 2 and 3 contain conventional single-pole single-throw contacts, conventional toggle mechanisms and conventional wire termination screws; none of which are shown. The two switches are interchangeable in a wiring system. Switch 3 is a mirror image of switch 2. The two switch bodies 2 and 3 are riveted 14 to the yoke 1 as conventional switch bodies are. Switch 3 does not have a toggle handle associated with it for on-off operation. Its toggle mechanism is operated by the rotation of the axle 5 that is integral to the protrusion that operates the toggle mechanism of switch 3 on one end and integral to the handle 4 as well as the protrusion that operates the toggle mechanism of switch 2 on the opposite end; thereby the two switches switch on-off in unison. Four holes 7 are provided for attachment of the yoke 1 to a standard 2-gang wallbox 13 and threaded holes 8 are provided for the attachment of a standard coverplate. The axle 5 has a collar 6 that is an integral part of the axle.

Figure 2A:
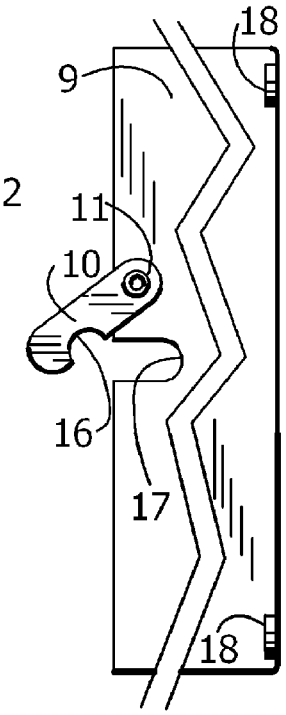
FIG. 2*a* is a partial planar view of the required partition that has a first slot cut-out that is juxtaposed to the location of the axle that operates both switches. The Figure also shows how a pivotable flat piece with a second slot cut-out that is a mirror image of the first slot cut-out and forms the second half of an aperture that encompasses the axle. The pivotable piece is shown in the open position.
Figure 2B:
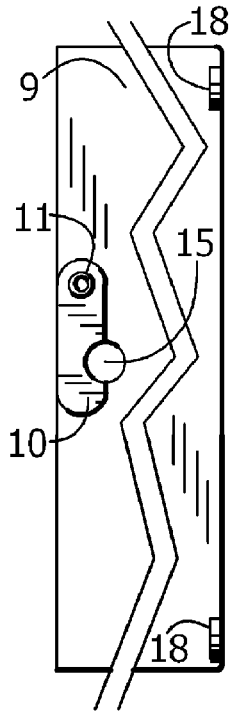
FIG. 2*b* is the device of FIG. 2*a* but shown with the pivotable piece in the closed position thereby forming the aperture that encompasses the axle.

FIGS. 2*a* and 2*b* illustrate the partition device 9 that has attached a flat plate 10 that pivots about a rivet 11. The partition device 9 has a slot cut-out 17 the size and shape of the axle 5. The pivoting flat plate 10 has a slot cut-out 16 with size and shape that, in combination with the slot cut-out of the flat plate 10 forms an aperture 15 encompassing the axle 5 when placed in the wallbox 13 (see FIG. 3) between switch 2 and 3 (see FIG. 1) thereby effectively dividing the wallbox 13 into two separate enclosures as required by the National Electrical Code (NEC) 700.9 (B). The aperture 15 formed by the two slots 16 and 17 is of such diameter that it provides 2 mm maximum clearance between the axle 5 and the circumference of the aperture 15 thereby complying with UL maximum clearance requirements. The partition 9 also has two ears 18 with screw holes spaced apart along the back edge of the partition 9 bent at right angle to the planar surface for anchoring to the back of the wallbox 13 with self tapping screws 19.

Figure 3:
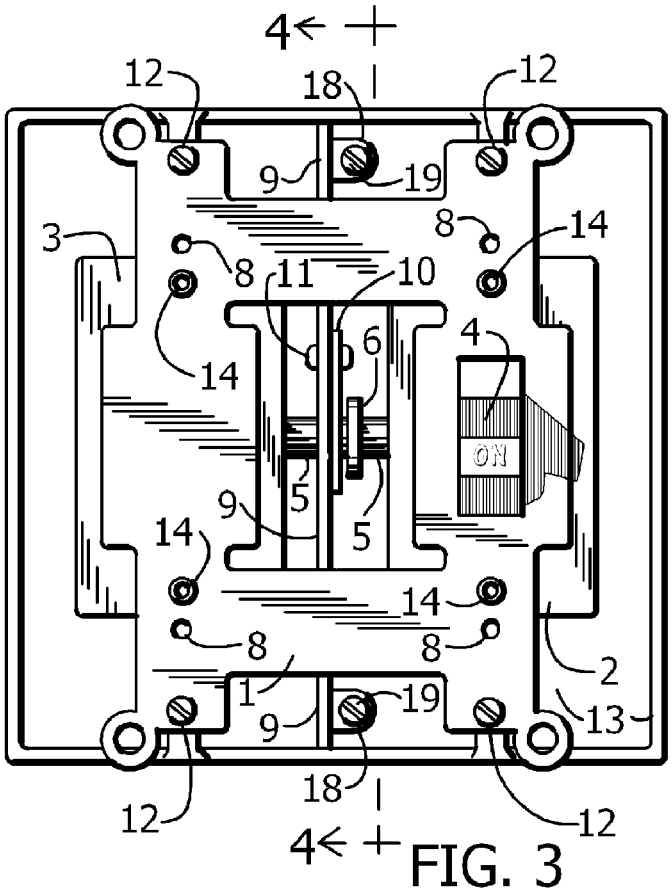
FIG. 3 is a front view of the switch assembly mounted in a standard 2-gang wallbox with the partition of FIG. 2*b* mounted between the two switches where standard grooves formed at the mid-point of the standard 2-gang wall box holds the partition in place in an orientation parallel to the side walls of the wallbox and perpendicular to the yoke.

FIG. 3 illustrates how the partition 9 mounts inside the wallbox 13 held in place with two self tapping screws 19. It also illustrates how the complete switch assembly mounts inside the wallbox 13 held in place with four screws 12.

Figure 4:
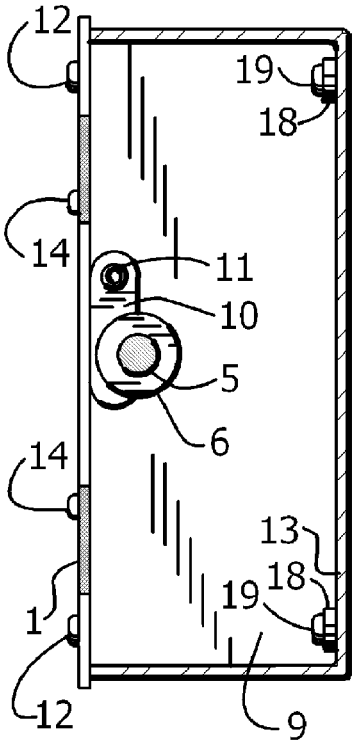
FIG. 4 is a view taken along plane 4—4 of FIG. 1 showing a section through the wallbox and the axle that operates the second switch in unison with the first switch when the switch handle is operated on-off.

FIG. 4 illustrates a section taken along plane 4—4 of FIG. 3 that shows that the partition 9 is anchored with self tapping screws 19 at the back of the wallbox 13 and that the partition pivotable piece 10 closes around the axle 5 and that the collar 6 of the axle 5 overlaps the clearance between the axle 5 and the partition 9 and its closed pivotable piece 10 thereby providing additional integrity for the partition 9 that divides the wallbox 13 into two separate gangs per NEC 700.9 (B).

Figure 5:
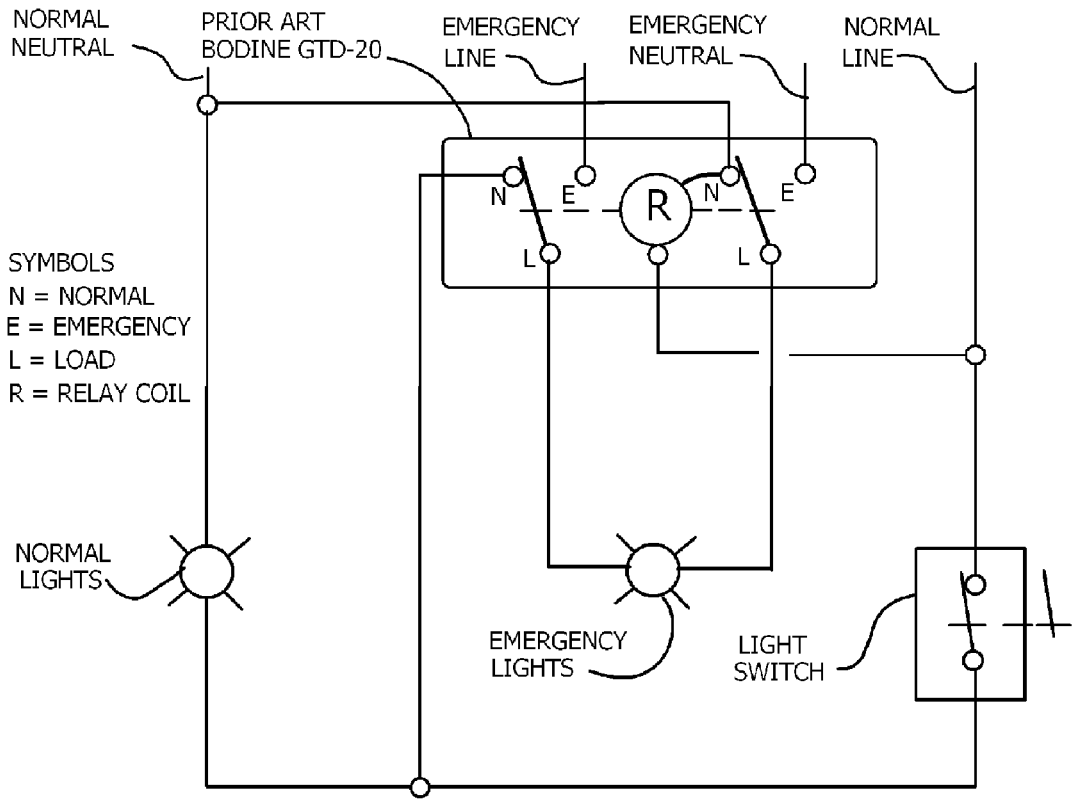
FIG. 5 is a wiring diagram illustrating the prior art of Bodine's GTD-20 connected to a lighting system.

FIG. 5 illustrates that the prior art requires twelve wire terminations when connected to a lighting system.

Figure 6:
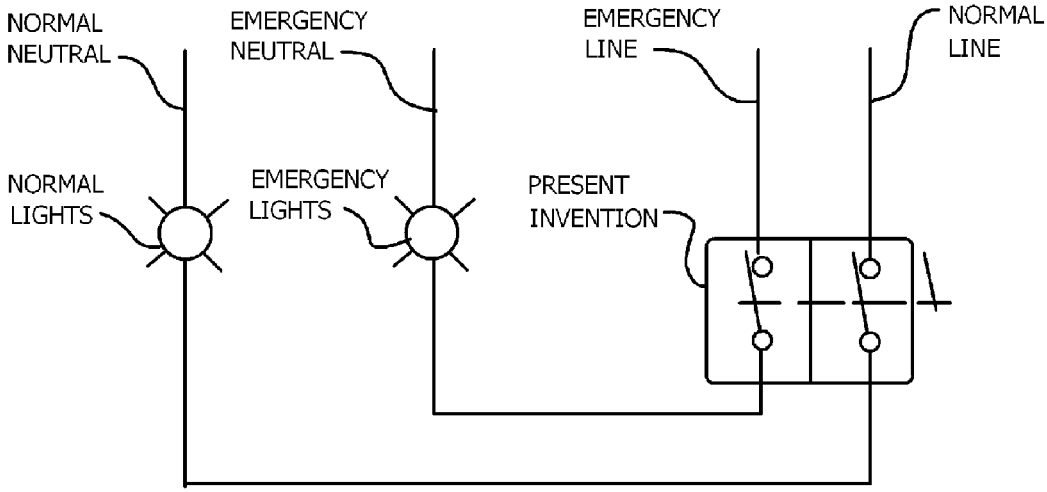
FIG. 6 is a wiring diagram illustrating the present invention connected to a lighting system.

FIG. 6 illustrates that the present invention requires only four wire terminations when connected to a lighting system.

What is claimed is:

1. A 2-gang wallbox-mountable light switch assembly that comprises two switches for controlling in unison, by an on-off motion of a single switch handle, both normal and emergency circuits supplying power to normal and emergency lights in a room whereas electrical components of said two switches are separated by a wallbox partition;

a first light switch body having single-pole single-throw contacts, ordinary wire terminals and spring loaded toggle mechanism; a round opening is provided on one side of the switch body that acts as a bearing surface for an axle means about which said switch handle and toggle operator pivot;

a second light switch body that is a mirror image of said first switch body with one exception; there is no opening for a switch handle;

a yoke means having grounding terminals; said yoke means being rivetably attached to said first and second switch bodies and mounted to said wallbox with screws;

an axle means having a single handle for turning on-off in unison both switches; and a partition means to separate said contacts and terminals of said first switch from said contacts and terminals of said second switch.

2. The device in accordance with claim 1 wherein said partition means comprises a thin flat plate having a contour that matches an interior contour of said wallbox with a maximum clearance of 2 mm all around a perimeter; when anchored with screws in said wallbox said partition means effectively divides said wallbox into two 1-gang spaces whereas said partition comprises;

a first electrically non-conductive thin flat plate with two spaced apart ears bent 90 degrees with screw holes for anchoring to the back of said wallbox using two self tapping screws; said first thin flat plate further having a slot cut-out sized and shaped to allow said axle means to be positioned within said slot cut-out perpendicular to said first thin flat plate whereas there is a maximum of 2 mm clearance between the semi-circular portion of said slot and said axle; and a second electrically non-conductive thin flat plate with a slot cut-out that is a mirror image of said slot cut-out in said first thin flat plate; said second thin flat plate being rivetably mounted to said first thin flat plate in a location that, when rotated to a closed position, said slot cut-out of said second thin flat plate forms a second half of a round aperture which encompasses said axle with a maximum clearance of 2 mm; when in said closed position the planar surfaces of both thin flat plates are perpendicular to an interior planar surface of said yoke means and parallel to the sides of said wallbox; outer edges of both said thin flat plates are flush with an interior planar surface of said yoke means.

3. The device in accordance with claim 2 wherein said yoke means supporting said switches comprises a thin electrically non-conductive flat plate with an opening on one side to correspond with the size and location of said handle thereby allowing said handle to protrude through said opening; said yoke means is riveted to both switches; four holes are provided in said yoke means that correspond to four device mounting holes in said wallbox; four threaded holes in said yoke means correspond to the size and location of standard 2-gang coverplate mounting screws.

4. The device in accordance with claim 3 wherein said axle means is round, electrically non-conductive and has radial projections on each end sized and shaped to engage and operate on-off said toggle mechanism of each said switch; a radial projection on one end is sized and shaped to fit freely through a light switch opening of a 2-gang light switch coverplate thereby serving as said handle for manual grasping and rotating of said axle for turning on-off in unison both said switches; said axle means has an integral round collar sized and positioned flush against said partition means to cover the clearance between said axle means and said partition means to effectively divide said wallbox into two separate gangs.

5. The device in accordance with claim 4 wherein said collar of said axle means is metallic; a portion of said axle means extending from said collar to a point between said partition means and said second switch body is metallic; the metallic portion of said axle means is bonded at each end to said electrically nonconductive portions of said axle means; said partition means is metallic.

* * * * *